US009517547B2

(12) United States Patent
Kasashima et al.

(10) Patent No.: US 9,517,547 B2
(45) Date of Patent: Dec. 13, 2016

(54) SUPER HARD ALLOY BASEPLATE OUTER CIRCUMFERENCE CUTTING BLADE AND MANUFACTURING METHOD THEREOF

(75) Inventors: Masaki Kasashima, Echizen (JP); Takehisa Minowa, Echizen (JP); Harukazu Maegawa, Echizen (JP); Yoshifumi Nagasaki, Echizen (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 470 days.

(21) Appl. No.: 13/990,143

(22) PCT Filed: Nov. 28, 2011

(86) PCT No.: PCT/JP2011/077309

§ 371 (c)(1),
(2), (4) Date: May 29, 2013

(87) PCT Pub. No.: WO2012/073854

PCT Pub. Date: Jun. 7, 2012

(65) Prior Publication Data

US 2013/0252522 A1 Sep. 26, 2013

(30) Foreign Application Priority Data

Nov. 29, 2010 (JP) ..... 2010-264811
Nov. 29, 2010 (JP) ..... 2010-264844

(51) Int. Cl.
*B24D 5/12* (2006.01)
*B24D 5/02* (2006.01)
*B24D 3/06* (2006.01)

(52) U.S. Cl.
CPC . *B24D 5/12* (2013.01); *B24D 3/06* (2013.01); *B24D 5/02* (2013.01)

(58) Field of Classification Search
CPC ..... B24D 3/06; B24D 3/10; B24D 5/02; B24D 5/12
(Continued)

(56) References Cited

U.S. PATENT DOCUMENTS 4,155,721 A * 5/1979 Fletcher ..... C25D 15/02 205/110
6,098,609 A 8/2000 Ishizuka
(Continued)

FOREIGN PATENT DOCUMENTS

EP 0620082 A1 10/1994
JP 07-207254 A 8/1995
(Continued)

OTHER PUBLICATIONS

Search Report dated Oct. 7, 2014, issued in corresponding Singaporean Patent Application No. 2013041512 (8 pages).
(Continued)

*Primary Examiner* — Eileen Morgan
(74) *Attorney, Agent, or Firm* — Westerman, Hattori, Daniels & Adrian, LLP

(57) ABSTRACT

The disclosed cemented carbide base outer blade cutting wheel comprises a base in the form of an annular thin disc of cemented carbide, and a blade section on the outer periphery of the base. The blade section contains: diamond and/or CBN abrasive grains pre-coated with a magnetic material; a metal or alloy bond formed by electroplating or electroless plating for bonding abrasive grains together and to the base; and a metal or alloy binder having a melting point of up to 350° C. infiltrated between abrasive grains and between abrasive grains and the base. The method for manufacturing said outer blade cutting wheel is also disclosed.

15 Claims, 5 Drawing Sheets

(58) Field of Classification Search
USPC ..... 451/541, 544, 546; 125/13.01, 15
See application file for complete search history.

(56) References Cited

U.S. PATENT DOCUMENTS

| | | | | |
|---|---|---|---|---|
| 2009/0165768 | A1* | 7/2009 | Kasashima ..... | B23D 61/028 125/15 |
| 2010/0000159 | A1 | 1/2010 | Walia et al. | |
| 2010/0275522 | A1 | 11/2010 | Kasashima et al. | |
| 2012/0252330 | A1 | 10/2012 | Kasashima et al. | |

FOREIGN PATENT DOCUMENTS

| | | | |
|---|---|---|---|
| JP | 08-150568 | A | 6/1996 |
| JP | 09-174441 | A | 7/1997 |
| JP | 10-175171 | A | 6/1998 |
| JP | 10-175172 | A | 6/1998 |
| JP | 2942989 | B1 | 8/1999 |
| JP | 2005-193358 | A | 7/2005 |
| JP | 2005-219169 | A | 8/2005 |
| JP | 2009-172751 | A | 8/2009 |
| JP | 2010-260124 | A | 11/2010 |
| WO | 96/23630 | A1 | 8/1996 |

OTHER PUBLICATIONS

Written Opinion dated Oct. 7, 2014, issued in corresponding Singaporean Patent Application No. 2013041512 (11 pages).
International Search Report for PCT/JP2011/077309, mailing date of Jan. 24, 2012; With English translation.
R. Nenpyo, Edited by National Astronomical Observatory of Japan, vol. 72, Maruzen Co., Ltd., pp. 453-469, Nov. 30, 1998.

* cited by examiner

SUPER HARD ALLOY BASEPLATE OUTER CIRCUMFERENCE CUTTING BLADE AND MANUFACTURING METHOD THEREOF

TECHNICAL FIELD

This invention relates to a cemented carbide base outer-diameter blade cutting wheel suited for cutting rare earth sintered magnets, and a method for preparing the same.

BACKGROUND ART

For cutoff machining of rare earth sintered magnet blocks (or permanent magnet blocks), various cutting techniques such as outer diameter cutting, inner diameter cutting and wire saw cutting are implemented. Among others, outer-diameter blade cutting wheels are most widely employed. The outer-diameter blade cutting technique has many advantages including less expensive cutting tools, a relatively low cutting allowance associated with cemented carbide blades, a good dimensional accuracy of cut pieces, and a relatively high machining speed. Owing to these advantages and improved mass productivity, the outer-diameter blade cutting technique is widely used in the cutting of rare earth sintered magnet blocks.

Outer-diameter blade cutting wheels for cutting rare earth sintered magnets are disclosed in JP-A H09-174441, JP-A H10-175171, and JP-A H10-175172 as comprising a cemented carbide base having an outer periphery to which diamond or CBN abrasive grains are bonded with phenolic resins, nickel plating or the like. Since the base made of cemented carbide is improved in mechanical strength over prior art alloy tool steel or high-speed steel, there are achieved an improvement in the machining accuracy, an improvement in the yield of pieces due to reduced allowance by the use of thin blades, and a reduction of machining cost due to high-speed machining.

While outer-diameter blade cutting wheels using cemented carbide bases are improved in cutting and working performances over the prior art outer-diameter blade cutting wheels, the market imposes a continuing demand for cost reduction. It would be desirable to have a high-performance cutting wheel capable of machining at a high accuracy and high speed.

CITATION LIST

Patent Document

Patent Document 1: JP-A H09-174441
Patent Document 2: JP-A H10-175171
Patent Document 3: JP-A H10-175172
Patent Document 4: JP-A 2005-193358
Patent Document 5: JP-A H07-207254
Patent Document 6: JP 2942989
Patent Document 7: JP-A 2005-219169
Patent Document 8: WO 96/23630
Patent Document 9: JP-A 2009-172751

SUMMARY OF INVENTION

Technical Problem

The applicant previously proposed a technique of bonding diamond abrasive grains to the periphery of an annular cemented carbide base with a resin such as phenolic resin and a technique of bonding diamond or CBN abrasive grains to the periphery of an annular cemented carbide base with a metal bond having an appropriate Young's modulus (JP-A 2009-172751).

The outer blade cutting wheel for use in the cutting of rare earth sintered magnet blocks is composed of two sections, a base and a blade section. Now that the base accounting for the majority of the cutting wheel is made of high-modulus cemented carbide, the cutting wheel is improved in mechanical strength and hence, in cutting accuracy over the prior art cutting wheels having alloy tool steel and high-speed steel bases. The switch to a metal bond having an appropriate Young's modulus, combined with the cemented carbide base, improves the mechanical strength of the overall cutting wheel, thereby achieving three performance improvements, an improvement in the machining accuracy, an improvement in the yield of material due to the use of thin blades, and a reduction of machining cost due to high cutting speed, as compared with the prior art outer blade cutting wheels of the resin bond type using phenolic resins or polyimide resins as the bond for abrasive grains.

Cemented carbide base outer blade cutting wheels can be manufactured by producing a magnetic field near the outer periphery of the cemented carbide base, the magnetic field acting on abrasive grains pre-coated with a magnetic material so as to magnetize the coating on abrasive grains, thereby attracting the abrasive grains toward the base outer periphery, and effecting plating in this state, thereby bonding the abrasive grains to the outer periphery. The method reduces the cost of manufacture of outer blade cutting wheels.

The cemented carbide base outer blade cutting wheel produced by the above-mentioned method is an outer blade cutting wheel featuring high performance. When a rare earth sintered magnet block is cut into magnet pieces by the wheel, sometimes the dimensional accuracy is aggravated because the block can be obliquely cut, or cutting marks by the wheel be left on the cut surface of a magnet piece. Specifically, when a cemented carbide base outer blade cutting wheel having an outer diameter of 80-200 mm, a bore diameter of 30-80 mm, and a thickness of 0.1-1.0 mm, for example, is used and operated to perform high-speed, high-load cutting at a machining volume per unit time of at least 200 $mm^3$/min, a dimensional tolerance may exceed 50 μm. If the dimensional accuracy is aggravated, some remedies are necessary. For example, the magnet pieces must be subjected to an additional step of precision grinding the cut surface such as by lapping. The outer blade cutting wheel must be dressed using a grinding wheel or the cutting conditions be altered.

This becomes a barrier in the machining of magnet pieces which are suited for use in motors in which a strict management of the clearance between a yoke and a magnet is required such as linear motors and hard disc voice coil motors (VCM) and which require both a high dimensional accuracy (including the flatness of cut surface) and a reduction of manufacture cost.

An object of the invention is to provide a cemented carbide base outer blade cutting wheel capable of cutting a rare earth sintered magnet block into pieces having a high dimensional accuracy, and a method for preparing the outer blade cutting wheel at a low cost.

Solution to Problem

It is presumed that a phenomenon that a rare earth sintered magnet block is obliquely cut takes place because the outer blade cutting wheel has a blade shape which is not laterally symmetric, allowing cutting operation to proceed in a direction of easy cutting, and because the outer blade cutting wheel is warped when it is mounted on a machining tool. It is also presumed that a phenomenon that cut marks are left on magnet pieces takes place because when the outer blade cutting wheel which is cutting the magnet block obliquely for the above reason changes its travel direction abruptly on the way of cutting operation, the cut surface which is newly cut does not smoothly merge with the cut surface which has been cut, forming a step.

An abrupt change of the travel direction of the outer blade cutting wheel during cutting operation occurs, for example, when the blade of the outer blade cutting wheel is, in part, deformed or spalled for some reason; when the blade edge abruptly changes its shape; when the blade is deformed by the feed speed of the cutting wheel which is higher than the grinding speed of the blade, the internal stress induced in the blade by that deformation becomes greater than the external force applied from the workpiece to the blade, and as a consequence, the force causing deformation of the blade is released; and when the travel of the outer blade cutting wheel is interrupted by loading or glazing of the cutting groove with sludge formed during cutting operation or foreign matter of external origin. To eliminate any cut marks which can form under such conditions, it is effective that the blade edge does not abruptly change its shape, and that when any force is applied to the blade so as to change its travel direction during cutting operation, the blade is deformed to such an extent as to smoothly merge the cut surfaces before and after the change.

A void problem arises in the outer blade cutting wheel in which abrasive grains are bonded to a base by electroplating or electroless plating to form a blade section. Since the abrasive grains have a certain grain size, the bonded abrasive grains are contacted only in part between grains and between grains and the base, and voids therebetween are not completely buried by plating. As a result, voids are left in the blade section even after plating. That is, the blade section contains voids in communication with the surface.

As long as the load applied to the outer blade cutting wheel during cutting operation is low, high accuracy cutting is possible, even in the presence of such voids, because the blade section does not undergo substantial deformation by the force applied during cutting. However, where cutting is carried out under such a high load as to cause the cemented carbide base to be deformed, the blade edge can be in part deformed or shed. An effective method for preventing the blade edge from deformation or shedding is by enhancing the strength of the blade edge. Since the blade section should have a sufficient elasticity to allow the blade section to deform to enable smooth mergence of cut surfaces as will be described later, the mere enhancement of blade strength to be resistant to deformation fails to address the problem.

Making further investigations on the construction of the blade section that meets both high strength and elasticity and the necessary mechanical properties of the blade section, the inventors have found that an effective blade section is obtained by utilizing voids between abrasive grains and between abrasive grains and the base, specifically by letting a metal or alloy infiltrate in the voids. An outer blade cutting wheel comprising a cemented carbide base and such a blade section is effective in improving the dimensional accuracy of magnet pieces cut thereby. The technique of infiltrating a metal or alloy is effective for the manufacture of an outer blade cutting wheel featuring a high cutting accuracy and low cost. The invention is predicated on these findings.

In one aspect, the invention provides an outer blade cutting wheel comprising a base in the form of an annular thin disc of cemented carbide having a Young's modulus of 450 to 700 GPa, having an outer diameter of 80 to 200 mm defining an outer periphery, an inner diameter of 30 to 80 mm, and a thickness of 0.1 to 1.0 mm, and a blade section on the outer periphery of the base, the blade section comprising diamond and/or CBN abrasive grains pre-coated with a magnetic material, a metal or alloy bond formed by electroplating or electroless plating for bonding abrasive grains together and to the base, and a metal or alloy binder having a melting point of up to 350° C. infiltrated between abrasive grains and between abrasive grains and the base.

In a preferred embodiment, the binder metal is Sn and/or Pb, and the binder alloy is at least one alloy selected from the group consisting of Sn—Ag—Cu, Sn—Ag, Sn—Cu, Sn—Zn, and Sn—Pb alloys. Also preferably, the metal or alloy binder has a Poisson's ratio between 0.3 and 0.48.

In a preferred embodiment, the base has a saturation magnetization of at least 40 kA/m (0.05 T).

In a preferred embodiment, the abrasive grains have an average grain size of 10 to 300 μm. Also preferably, the abrasive grains have a mass magnetic susceptibility $\chi g$ of at least 0.2.

In another aspect, the invention provides a method for manufacturing an outer blade cutting wheel comprising the steps of:

providing a base in the form of an annular thin disc of cemented carbide having a Young's modulus of 450 to 700 GPa, having an outer diameter of 80 to 200 mm defining an outer periphery, an inner diameter of 30 to 80 mm, and a thickness of 0.1 to 1.0 mm, providing diamond and/or CBN abrasive grains pre-coated with a magnetic material, placing a permanent magnet near the outer periphery of the base so that the magnetic field produced by the permanent magnet may act to magnetically attract and hold the coated abrasive grains close to the outer periphery of the base, electroplating or electroless plating a metal or alloy on the base outer periphery and the coated abrasive grains being magnetically attracted and held, for bonding the abrasive grains together and to the base to fixedly secure the abrasive grains to the base outer periphery to form a blade section, and letting a metal or alloy having a melting point of up to 350° C. infiltrate into any voids between abrasive grains and between abrasive grains and the base.

In a preferred embodiment, the infiltrating metal is Sn and/or Pb, and the infiltrating alloy is at least one alloy selected from the group consisting of Sn—Ag—Cu, Sn—Ag, Sn—Cu, Sn—Zn, and Sn—Pb alloys. Also preferably, the infiltrating metal or alloy has a Poisson's ratio between 0.3 and 0.48.

In a preferred embodiment, the base has a saturation magnetization of at least 40 kA/m (0.05 T).

In a preferred embodiment, the abrasive grains have an average grain size of 10 to 300 μm. Also preferably, the abrasive grains have a mass magnetic susceptibility $\chi g$ of at least 0.2.

In a preferred embodiment, the permanent magnet produces a magnetic field of at least 8 kA/m within a space extending a distance of 10 mm or less from the base outer periphery.

Advantageous Effects of Invention

Using the cemented carbide base outer blade cutting wheel, a rare earth magnet block is cut into magnet pieces.

With only the cutting operation, the magnet pieces are finished to a high dimensional accuracy. Any finishing following the cutting operation may be omitted. Rare earth magnet pieces having a high dimensional accuracy are obtained at a low cost. The method for manufacturing the outer blade cutting wheel is cost effective.

DESCRIPTION OF EMBODIMENTS

Figure 1A:
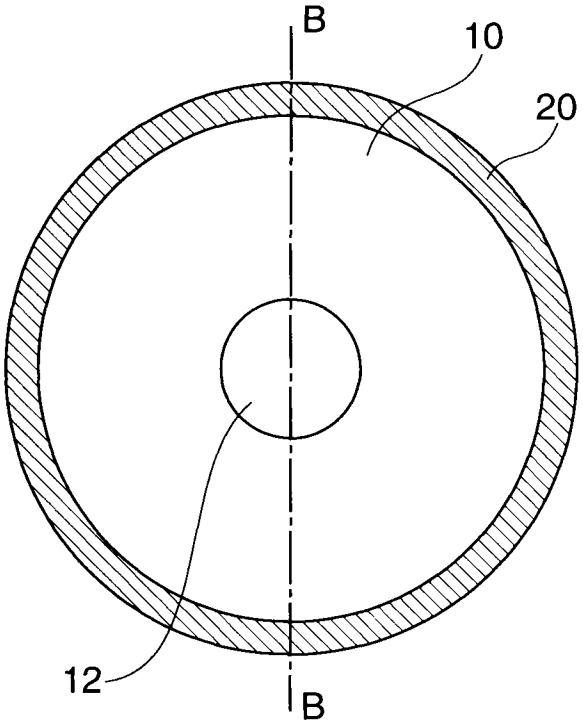
FIG. 1 schematically illustrates an outer blade cutting wheel in one embodiment of the invention, FIG. 1A being a plan view, FIG. 1B being a cross-sectional view taken along lines B-B in FIG. 1A, and FIG. 1C being an enlarged view of circle C (blade section) in FIG. 1B.
Figure 1B:
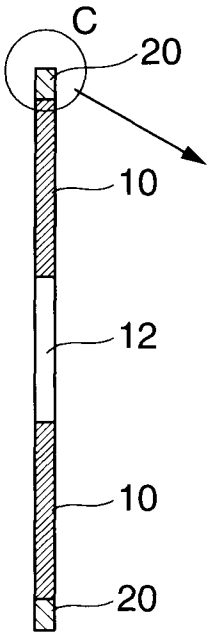
Figure 1C:
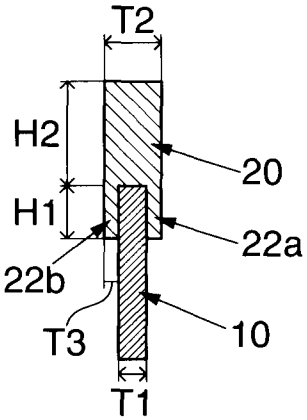

Referring to FIG. 1, the outer blade cutting wheel in one embodiment of the invention is illustrated as comprising a base 10 in the form of an annular thin disc made of cemented carbide and a blade section 20 disposed on the outer periphery of the base 10. The blade section 20 comprises diamond and/or CBN abrasive grains bonded with a metal or metal alloy bond by electroplating or electroless plating.

The base 10 is in the form of an annular thin disc (differently stated, a doughnut-shaped thin plate having a center bore 12) having an outer diameter of 80 to 200 mm, preferably 100 to 180 mm, defining an outer periphery, an inner diameter of 30 to 80 mm, preferably 40 to 70 mm, defining the bore 12, and a thickness of 0.1 to 1.0 mm, preferably 0.2 to 0.8 mm.

It is noted that the disc has a center bore and an outer circumference as shown in FIG. 1. Thus, the terms "radial" and "axial" are used relative to the center of the disc, and so, the thickness is an axial dimension, and the length (or height) is a radial dimension. Likewise the terms "inside" or "inward" and "outside" or "outward" are used relative to the center of the disc or the rotating shaft of the cutting wheel.

The base has a thickness in the range of 0.1 to 1.0 mm and an outer diameter in the range of not more than 200 mm because a base of such dimensions can be manufactured at a high accuracy and ensures consistent cut-off machining of a workpiece, typically a rare earth sintered magnet block at a high dimensional accuracy over a long term. A thickness of less than 0.1 mm leads to a likelihood of noticeable warpage independent of outer diameter and makes difficult the manufacture of a base at a high accuracy. A thickness in excess of 1.0 mm indicates an increased cutting allowance. The outer diameter is up to 200 mm in view of the size that can be manufactured by the existing technology of producing and processing cemented carbide. The diameter of the bore is set in a range of 30 to 80 mm so as to fit on the shaft of the cutoff machining tool.

Examples of the cemented carbide of which the base is made include those in which powder carbides of metals in Groups IVB, VB, and VIB of the Periodic Table such as WC, TiC, MoC, NbC, TaC and $Cr_3C_2$ are cemented in a binder matrix of Fe, Co, Ni, Mo, Cu, Pb, Sn or a metal alloy thereof, by sintering. Among these, typical WC—Co, WC—Ti, C—Co, and WC—TiC—TaC—Co systems are preferred. They should have a Young's modulus of 450 to 700 GPa. Also, those cemented carbides which have an electric conductivity susceptible to plating or which can be given such an electric conductivity with palladium catalysts or the like are preferred. When cemented carbides are given an electric conductivity with palladium catalysts or the like, well-known agents such as metallizing agents used in the metallization of ABS resins may be employed.

With respect to magnetic properties of the base, a greater saturation magnetization is preferred for holding abrasive grains to the base by magnetic attraction. Even in the case of a lower saturation magnetization, however, magnetic material-coated abrasive grains can be magnetically attracted toward the base by controlling the position of a permanent magnet and the strength of a magnetic field. For this reason, a base having a saturation magnetization of at least 40 kA/m (0.05 T) is satisfactory.

The saturation magnetization of a base is determined by cutting a sample of 5 mm squares out of a base having a given thickness, and measuring a magnetization curve ($4\pi I$-H) of the sample at a temperature of 24-25° C. by means of a vibrating sample magnetometer (VSM). The upper limit of magnetization values in the first quadrant is assigned as the saturation magnetization.

The outer periphery of the base may advantageously be chamfered (beveled or rounded) in order to enhance the bond strength between the base and the blade section which is formed thereon by bonding abrasive grains with a metal bond. Chamfering of the base periphery is advantageous in that even when the blade is over-ground in error beyond the boundary between the base and the abrasive layer during grinding for blade thickness adjustment purpose, the metal bond is left at the boundary to prevent the blade section from being separated apart. The angle and quantity of chamfer may be determined in accordance with the thickness of the base and the average grain size of abrasive grains because the range available for chamfering depends on the thickness of the base.

The abrasive grains used herein are diamond grains and/or CBN grains. The abrasive grains should have been coated with a magnetic material. The size and hardness of abrasive grains prior to the magnetic material coating are determined in accordance with the intended application.

For example, diamond grains (including natural diamond and industrial synthetic diamond) or cubic boron nitride (CBN) grains may be used alone. A mixture of diamond grains and CBN grains is also acceptable. Depending on the workpiece, abrasive grains of each type may be selected from single crystal grains and polycrystalline grains and used alone or in admixture for adjusting fragility. Further, sputtering a metal such as Fe, Co or Cr onto surfaces of abrasive grains to a thickness of about 1 μm is effective for enhancing the bond strength to the magnetic material to be subsequently coated.

Preferably abrasive grains have an average grain size of 10 to 300 μm although the grain size depends on the thickness of the base. If the average grain size is less than 10 μm, there may be left smaller voids between abrasive grains, allowing problems like glazing and loading to occur during the cutting operation and losing the cutting ability. If the average grain size is more than 300 μm, problems may arise, for example, magnet pieces cut thereby may have rough surfaces. With the cutting efficiency and lifetime taken into account, abrasive grains of a certain size within the range may be used alone or as a mixture of grains of different sizes.

The abrasive grains are previously coated with a magnetic material such that the coated abrasive grains may be magnetically attracted in a short time even to a base of low saturation magnetization cemented carbide and fixedly held thereto to prevent shedding during the bonding step by plating. Specifically, the coated abrasive grains may have a mass magnetic susceptibility $\chi g$ of preferably at least 0.2, more preferably at least 0.39. The magnetic material is typically at least one metal selected from Ni, Fe, and Co, an alloy of two or more such metals, or an alloy of one such metal or alloy with at least one metal selected from P and Mn. The abrasive grains are coated with such a magnetic material by any well-known technique such as sputtering, electroplating or electroless plating until the thickness of the coating reaches 0.5 to 100%, preferably 2 to 80% of the diameter of abrasive grains.

Since the magnetic susceptibility of coated abrasive grains depends on the magnetic susceptibility of the coating magnetic material and the thickness of the magnetic material coating, the type of magnetic material should be selected so as to gain a necessary attraction force for abrasive grains of a certain size. Nevertheless, even an electroless plated nickel-phosphorus coating having a low magnetic susceptibility due to a high phosphorus content can be increased in susceptibility to a certain extent by heat treatment. Also a multilayer coating of layers having different susceptibility is possible, for example, a coating including a layer having a low susceptibility and an overlying layer having a high susceptibility. Thus, the magnetic susceptibility of coated abrasive grains may be tailored in accordance with a particular situation.

Figure 3:
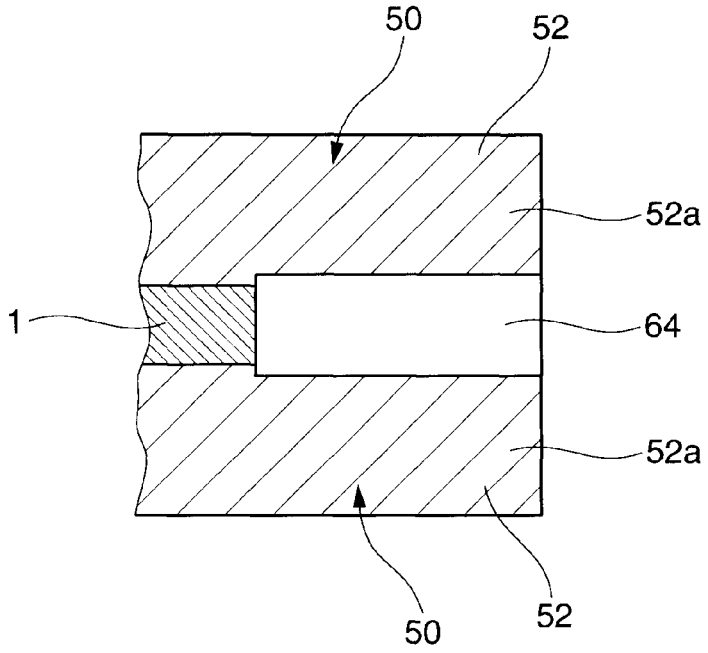
FIG. 3 is an enlarged cross-sectional view of the outer portions of the holders sandwiching the base in FIG. 2.

As long as the coated abrasive grains have a mass magnetic susceptibility $\chi g$ of at least 0.2, preferably at least 0.39, the coated abrasive grains are quickly magnetized by a magnetic field which is produced near the periphery of the base. Then the abrasive grains are magnetically attracted substantially equally at any sites within a space 64 defined by the base and permanent magnet holders of a jig as shown in FIG. 3. If the mass magnetic susceptibility $\chi g$ of the coated abrasive grains is less than 0.2, the abrasive grains within that space may not be fully attracted. With such weak attraction, some abrasive grains may fall off during plating, failing to form an abrasive grain layer (or blade section) or forming an abrasive grain layer which is porous and thus low in mechanical strength.

The mass magnetic susceptibility $\chi g$ of abrasive grains may be determined by providing a resinous vessel having an outer diameter of 8 mm, an inner diameter of 6 mm, and a height of 5 mm, distributing grains uniformly and thinly so as to form one or two layers of grains in the vessel, taking the grains out of the vessel, measuring the weight of the grains, returning them into the vessel, placing a paraffin with a melting point of about 50° C. on the grain layer, and heating the vessel in an oven at 60° C. Once the paraffin is melted, the vessel is closed with a lid and cooled. An initial magnetization curve ($4\pi I$-H) of the sample is measured at a temperature of 24-25° C. by means of a vibrating sample magnetometer (VSM). A gradient at the inflection point of the initial magnetization curve gives a differential susceptibility, which is divided by the sample weight, yielding the mass magnetic susceptibility $\chi g$ of abrasive grains. Notably, the magnetic field is calibrated using a standard Ni sample, and the density of abrasive grains is measured as a tap bulk density.

The thickness of magnetic material coating should fall in an appropriate range because the coating thickness can affect the size of voids created during formation of the blade section. The minimum thickness of coating is preferably 2.5 μm that is a thickness at which overall abrasive grains can be coated by plating without substantial voids. For example, for abrasive grains with an average grain size of 300 μm that is the maximum of the preferred average grain size range, the coating thickness may be at least 0.5%, more preferably at least 0.8% of the grain size. As long as the coating of magnetic material has a thickness in the range, it offers a retaining force capable of reducing shedding of abrasive grains when the outer blade cutting wheel is used in cutting operation. As long as a magnetic material of proper type is selected for coating, abrasive grains are attracted and held to or near the outer periphery of the base by the magnetic field during the plating step, without falling off.

For abrasive grains with an average grain size of 10 μm that is the minimum of the preferred average grain size range, the maximum coating thickness is preferably up to 100% of the average grain size of abrasive grains, because otherwise a fraction of abrasive grains not effectively functioning during cutting operation increases, a portion of preventing self-sharpening of abrasive grains increases, and the machining ability degrades.

The metal bond for bonding abrasive grains together is a plating metal or alloy. When a blade section is to be formed, a permanent magnet must be disposed near the outer periphery of the base to produce a magnetic field. For example, two or more permanent magnets having a remanence (or residual magnetic flux density) of at least 0.3 T are disposed on the side surfaces of the base positioned inside the outer periphery thereof or within spaces disposed inside the outer periphery of the base and spaced a distance of not more than 20 mm from the side surfaces of the base, to thereby produce a magnetic field of at least 8 kA/m in a space extending a distance of 10 mm or less from the outer periphery of the base. The magnetic field acts on the diamond and/or CBN abrasive grains pre-coated with a magnetic material, to produce a magnetic attraction force. By this magnetic attraction force, the abrasive grains are magnetically attracted and fixedly held to or near the base outer periphery. With the abrasive grains held fixedly, electroplating or electroless plating of a metal or alloy is carried out on the base outer periphery for thereby bonding the abrasive grains to the base outer periphery.

The jig used in this process comprises a pair of holders each comprising a cover of insulating material having a greater outer diameter than the outer diameter of the base and a permanent magnet disposed on and fixedly secured to the cover inside the base outer periphery. Plating may be carried out while the base is held between the holders.

Figure 2:
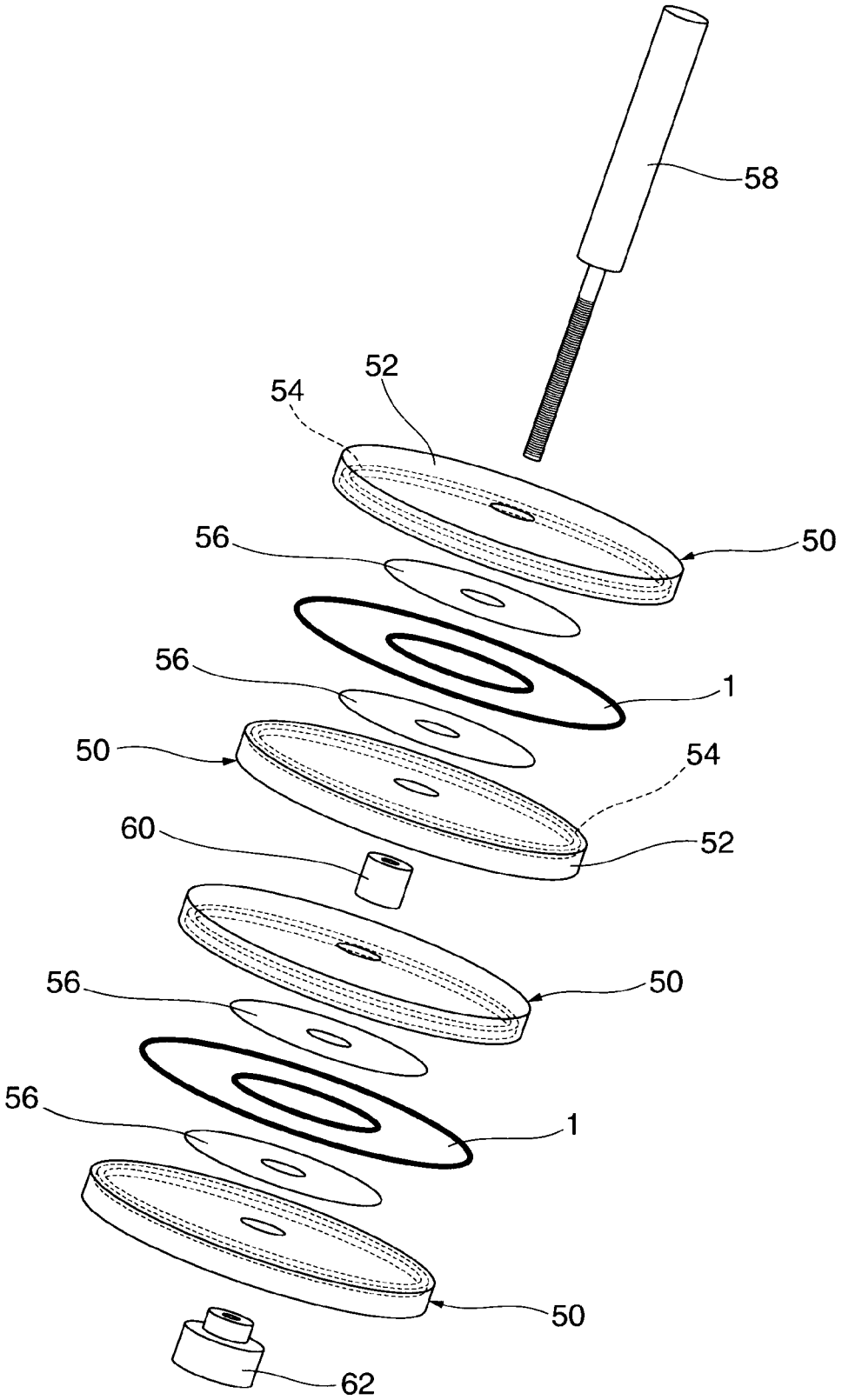
FIG. 2 is a perspective exploded view of one exemplary jig used in the method.

Referring to FIGS. 2 and 3, one exemplary jig for use in the plating process is shown. The jig comprises a pair of holders 50, 50 each comprising a cover 52 of insulating material and a permanent magnet 54 mounted on the cover 52. A base 1 is sandwiched between the holders 50 and 50. The permanent magnet 54 is preferably buried in the cover 52. Alternatively, the permanent magnet 54 is mounted on the cover 52 so that the magnet 54 may be in abutment with the base 1 when assembled.

The permanent magnet built in the jig should have a magnetic force sufficient to keep abrasive grains attracted to the base during the plating process of depositing a metal bond to bond abrasive grains. Although the necessary magnetic force depends on the distance between the base outer periphery and the magnet, and the magnetization and susceptibility of a magnetic material coated on abrasive grains, a desired magnetic force may be obtained from a permanent magnet having a remanence of at least 0.3 T and a coercivity of at least 0.2 MA/m, preferably a remanence of at least 0.6 T and a coercivity of at least 0.8 MA/m, and more preferably a remanence of at least 1.0 T and a coercivity of at least 1.0 MA/m.

The greater remanence a permanent magnet has, the greater gradient the magnetic field produced thereby has. Thus a permanent magnet with a greater remanence value is convenient when it is desired to locally attract abrasive grains. In this sense, use of a permanent magnet having a remanence of at least 0.3 T is preferred for preventing abrasive grains from separating apart from the base due to agitation of a plating solution and vibration by rocking motion of the base-holding jig during the plating process.

As the coercivity is greater, the magnet provides a stronger magnetic attraction of abrasive grains to the base for a long period even when exposed to a high-temperature plating solution. Then the freedom of choice with respect to the position, shape and size of a magnet used is increased, facilitating the manufacture of the jig. A magnet having a higher coercivity is selected from those magnets meeting the necessary remanence.

In view of potential contact of the magnet with plating solution, the permanent magnet is preferably coated so that the magnet may be more corrosion resistant. The coating material is selected under such conditions as to minimize the dissolution of the coating material in the plating solution and the substitution for metal species in the plating solution. In an embodiment wherein a metal bond is deposited from a nickel plating bath, the preferred coating material for the magnet is a metal such as Cu, Sn or Ni or a resin such as epoxy resin or acrylic resin.

The shape, size and number of permanent magnets built in the jig depend on the size of the cemented carbide base, and the position, direction and strength of the desired magnetic field. For example, when it is desired to uniformly bond abrasive grains to the base outer periphery, a magnet ring corresponding to the outer diameter of the base may be disposed, or arc shaped magnet segments corresponding to the outer diameter of the base or rectangular parallelepiped magnet segments having a side of several millimeters long may be continuously and closely arranged along the base outer periphery. For the purpose of reducing the cost of magnet, magnet segments may be spaced apart to reduce the number of magnet segments.

The spacing between magnet segments may be increased, though depending on the remanence of magnet segments used. With magnet segments spaced apart, magnetic material-coated abrasive grains are divided into one group of grains attracted and another group of grains not attracted. Then abrasive grains are alternately bonded to some areas, but not to other areas of the base outer periphery. A blade section consisting of spaced segments is formed.

With respect to the magnetic field produced near the base outer periphery, a variety of magnetic fields can be produced by changing a combination of the position and magnetization direction of permanent magnets mounted to two holders sandwiching the base. By repeating magnetic field analysis and experiments, the arrangement of magnets is determined so as to produce a magnetic field of at least 8 kA/m, preferably at least 40 kA/m within a space extending a distance of 10 mm or less from the outer periphery of the base. When the strength of the magnetic field is less than 8 kA/m, it has a short magnetic force to attract magnetic material-coated abrasive grains, and if plating is carried out in this state, abrasive grains may be moved away during the plating process, and as a consequence, a blade section having many voids is formed, or abrasive grains are bonded in a dendritic way, resulting in a blade section having a size greater than the desired. Subsequent dressing may cause the blade section to be separated apart or take a longer time. These concerns may increase the cost of manufacture.

Preferably the permanent magnet is placed nearer to the portion to which abrasive grains are attracted. Generally speaking, the permanent magnet is placed on the side surface of the base inside the outer periphery thereof or within a space situated inside the outer periphery of the base and extending a distance of not more than 20 mm from the side surface of the base and preferably within a space situated inside the outer periphery and extending a distance of not more than 10 mm from the side surface of the base. At least two permanent magnets having a remanence of at least 0.3 T (specifically at least one magnet per holder) are placed at specific positions within the spaces such that the magnets are entirely or partially situated within the spaces whereby a magnetic field having a strength of at least 8 kA/m can be produced within a space extending a distance of not more than 10 mm from the outer periphery of the base. Then, independent of whether the base is made of a material having a high saturation magnetization and a likelihood to induce a magnetic force such as alloy tool steel or high-speed steel, or a material having a low saturation magnetization and a less likelihood to induce a magnetic force such as cemented carbide, a magnetic field having an appropriate magnetic force can be produced near the outer periphery of the base. When magnetic material-coated abrasive grains are fed in the magnetic field, the coating is magnetized and consequently, the abrasive grains are attracted and held to or near the outer periphery of the base.

With respect to the position of the magnet relative to the outer periphery of the base, if the magnet is not placed within the space defined above, specifically if the magnet is placed outside the outer periphery of the base, though close thereto, for example, at a distance of 0.5 mm outward of the outer periphery of the base, then the magnetic field strength near the outer periphery of the base is high, but a region where the magnetic field gradient is reversed is likely to exist. Then abrasive grains tend to show a behavior of emerging upward from the base and shedding away. If the position of the magnet is inside the outer periphery of the base, but at a distance of more than 20 mm from the outer periphery of the base, then the magnetic field in the space extending a distance of not more than 10 mm from the outer periphery of the base tends to have a strength of less than 8 kA/m, with a risk of the force of magnetically attracting abrasive grains becoming short. In such a case, the strength of the magnetic field may be increased by enlarging the size of magnet. However, a large sized magnet produces a magnetic field of increased strength not only near the site to which abrasive grains are attracted, but over the surrounding, which is undesirable because some abrasive grains can be attached to the site to which abrasive grains are not to be attracted. A large sized magnet is not so practical because the magnet-built-in jig also becomes large.

The shape of the jig (holders) conforms to the shape of the base. The size of the jig (holders) is such that when the base is sandwiched between holders, the permanent magnet in the holder may be at the desired position relative to the base. For a base having an outer diameter of 125 mm and a thickness of 0.26 mm and an array of permanent magnet segments of 2.5 mm long by 2 mm wide by 1.5 mm thick, for example, a disc having an outer diameter of at least 125 mm and a thickness of about 20 mm is used as the holder.

Specifically, the outer diameter of the jig or holder is selected to be equal to or greater than {the outer diameter of the base plus (height of abrasive layer) multiplied by 2}, so as to ensure a height or radial protrusion (H2 in FIG. 10) of the abrasive grain layer, and the thickness of the jig or holder is selected so as to provide a strength sufficient to prevent warpage due to abrupt temperature changes by moving into and out of a hot plating bath. The thickness of the portion of the holder which comes in contact with abrasive grains may be reduced than the remaining portion so as to ensure an axial protrusion (T3 in FIG. 10) of the abrasive grain layer in the thickness direction of the base. A masking tape having a thickness equal to the axial protrusion may be attached to that portion so that the thickness may become equal to that of the remaining portion.

The material of which the jig or holders are made is preferably an insulating material on which no plating deposits, because the overall jig having the base sandwiched between the holders is immersed in a hot plating bath for depositing a metal bond on the base. More desirably the insulating material should have chemical resistance, heat resistance up to about 90° C., and thermal shock resistance sufficient to maintain the size constant even when exposed to repeated rapid thermal cycling in moving into and out of the plating bath. Also desirably the insulating material should have dimensional stability sufficient to prevent the holders from being warped by the internal stresses (accumulated during molding and working) to create a gap between the holder and the base when immersed in a hot plating bath. Of course, the insulating material should be so workable that a groove for receiving a permanent magnet at an arbitrary position may be machined at a high accuracy without fissures or chips.

Specifically, the holders may be made of engineering plastics such as PPS, PEEK, POM, PAR, PSF and PES and ceramics such as alumina. A holder is prepared by selecting a suitable material, determining a thickness and other dimensions in consideration of mechanical strength, molding the material to the dimensions, and machining a groove for receiving a permanent magnet and a recess for receiving an electric supply electrode which is necessary when electroplating is carried out. On use, a pair of such holders thus prepared is assembled so as to sandwich the base therebetween. When the holders are assembled together with an electrode for electric supply to the base to enable electroplating, this assembling procedure affords both electric supply and mechanical fastening and leads to a compact assembly as a whole. It is, of course, preferred that a plurality of jigs be connected as shown in FIG. 2 so that a plurality of bases may be plated at a time, because the production process becomes more efficient.

Specifically, as shown in FIG. 2, a cathode 56 which serves for electroplating and as a base retainer is fitted in a central recess in the cover 52. A jig is assembled by combining a pair of holders 50 with a base 1, inserting a conductive support shaft 58 into the bores of the holders and base, and fastening them together. In the assembled state, the cathodes 56 are in contact with the shaft 58, allowing for electric supply from the shaft 58 to the cathodes 56. In FIG. 2, two jigs each consisting of a pair of holders 50, 50 are mounted on the shaft 58 at a suitable spacing, using a spacer 60 and an end cap 62. Understandably the jig shown in FIG. 2 is intended for electroplating. In the case of electroless plating, the cathode is not necessary, a non-conductive retainer may be used instead, and the support shaft need not necessarily be conductive.

Using the jig, plating is carried out as follows. The jig is assembled by sandwiching the base 1 between the permanent magnet-built-in holders 50, 50. In this state, as shown in FIG. 3, a space 64 is defined by peripheral portions 52*a*, 52*a* (extending outward beyond the base) of covers 52, 52 of holders 50, 50 and the outer periphery of the base 1. A suitable amount of abrasive grains pre-coated with a magnetic material is weighed by a balance and fed into the space 64 where the abrasive grains are magnetically attracted and held.

The amount of abrasive grains held in the space depends on the outer diameter and thickness of the base, the size of abrasive grains, and the desired height and width of the blade section to be formed. Also preferably the process of holding abrasive grains and effecting plating is repeated plural times so that the amount of abrasive grains per unit volume may be equalized at any positions on the base outer periphery and abrasive grains may be tenaciously bonded by the plating technique.

In this way, a blade section is formed. The blade section preferably contains abrasive grains in a volume fraction of 10 to 80% by volume, and more preferably 30 to 75% by volume. A fraction of less than 10% by volume means that less abrasive grains contribute to cutting, leading to increased resistance during the cutting operation. A fraction in excess of 80% by volume means that the deformation amount of cutting edge during the cutting operation is reduced, leaving cut marks on the cut surface and aggravating the dimensional accuracy and appearance of cut pieces. For these reasons, the cutting speed must be slowed down. It is thus preferred to adjust the volume fraction of abrasive grains for a particular application by changing the thickness of the magnetic material coating on abrasive grains to change the grain size.

As shown in FIG. 10, the blade section 20 consists of a pair of clamp legs 22*a*, 22*b* which clamp the outer rim of the base 10 therebetween in an axial direction and a body (20) which extends radially outward beyond the outer rim (periphery) of the base 10. It is noted that this division is for convenience of description because the legs and the body are integral to form the blade section. The thickness of the blade section 20 is greater than the thickness of the base 10. To form the blade section of this design, the space 64 is preferably configured as shown in FIG. 3.

More specifically, the clamp legs 22*a*, 22*b* of the blade section 20 which clamp the outer rim of the base 10 therebetween each preferably have a length H1 of 0.1 to 10 mm, and more preferably 0.5 to 5 mm. The legs 22*a*, 22*b* each preferably have a thickness T3 of at least 5 μm (=0.005 mm), more preferably 5 to 2,000 μm, and even more preferably 10 to 1,000 μm. Then the total thickness of legs 22*a*, 22*b* is preferably at least 0.01 mm, more preferably 0.01 to 4 mm, and even more preferably 0.02 to 2 mm. The blade section 20 is thicker than the base 10 by this total thickness. If the length H1 of clamp legs 22*a*, 22*b* is less than 0.1 mm, they are still effective for preventing the rim of the cemented carbide base from being chipped or cracked, but less effective for reinforcing the base and sometimes fail to prevent the base from being deformed by the cutting resistance. If the length H1 exceeds 10 mm, reinforcement of the base is made at the sacrifice of expense. If the thickness T3 of clamp leg is less than 5 μm, such thin legs may fail to enhance the mechanical strength of the base or to effectively discharge the swarf sludge.

Figure 4A:
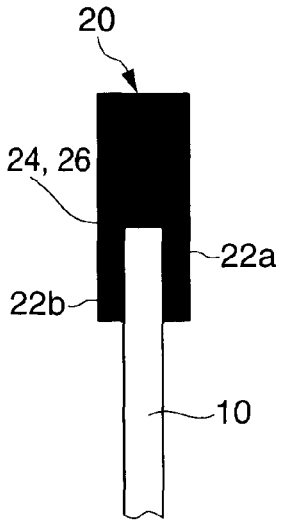
FIGS. 4A to 4D are cross-sectional views of different embodiments of the blade section formed on the base.
Figure 4B:
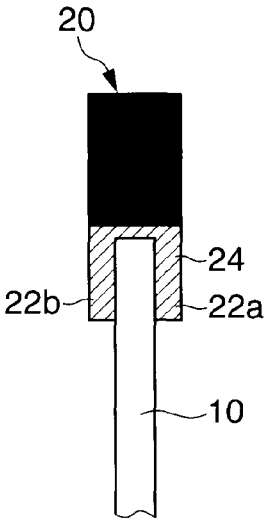
Figure 4C:
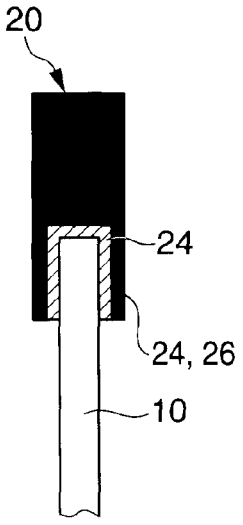
Figure 4D:
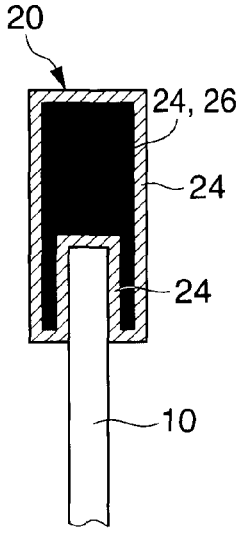

As shown in FIGS. 4A to 4D, the clamp legs 22*a*, 22*b* may consist of a metal bond 24 and abrasive grains 26 (FIG. 4A), consist of metal bond 24 (FIG. 4B), or include an underlying layer consisting of metal bond 24 covering the base 10 and an overlying layer consisting of metal bond 24 and abrasive grains 26 (FIG. 4C). Notably the strength of the blade section may be further increased by depositing a metal bond on the structure of FIG. 4C so as to surround the overall outer surface as shown in FIG. 4D.

In the embodiments shown in FIGS. 4B to 4D, the clamp leg inner portions in contact with the base 10 are formed solely of metal bond 24. To this end, the base is masked so that only the portions of the base on which the clamp legs are to be formed are exposed, and plating is carried out on the unmasked base portions. This may be followed by mounting the base in the jig, charging the space 64 with abrasive grains 26, and effecting plating. After the electroplating of abrasive grains, the base 10 may be masked with another pair of covers 52, 52 having a smaller outer diameter such that the electroplated portion is exposed, and plating is carried out again, forming a layer consisting of metal bond 24 as the blade section outermost layer as shown in FIG. 4D.

Referring back to FIG. 1C, the body of the blade section 20 which extends radially outward beyond the periphery of the base 10 has a length H2 which is preferably 0.1 to 10 mm, and more preferably 0.3 to 8 mm, though may vary with the size of abrasive grains to be bonded. If the body length H2 is less than 0.1 mm, the blade section may be consumed within a short time by impacts and wears during the cutting operation, which indicates a cutting wheel with a short lifetime. If the body length H2 exceeds 10 mm, the blade section may become susceptible to deformation, though dependent on the blade thickness (T2 in FIG. 10), resulting in cut magnet pieces with wavy cut surfaces and hence, worsening dimensional accuracy. The body of the blade section consists essentially of abrasive grains 26, metal bond 24, and metal binder.

The metal bond is a metal or alloy deposited by plating. The metal bond used herein is at least one metal selected from the group consisting of Ni, Fe, Co, Cu, and Sn, an alloy consisting of at least two of the foregoing metals, or an alloy consisting of at least one of the foregoing metals or alloys and one or both of phosphorus (P) and manganese (Mn). The metal or alloy is deposited by plating so as to form interconnects between abrasive grains and between abrasive grains and the base.

The method of depositing the metal bond by plating is generally classified into two, an electroplating method and an electroless plating method. In the practice of the invention, the electroplating method which is easy to control internal stresses remaining in the metal bond and low in production cost and the electroless (or chemical) plating method which ensures relatively uniform deposition of metal bond as long as the plating solution penetrates there may be used alone or in combination so that the blade section may contain voids in an appropriate range to be described later.

The stress in the plating film may be controlled by suitable means. For example, in single metal plating such as copper or nickel plating, typically nickel sulfamate plating, the stress may be controlled by selecting the concentration of the active ingredient or nickel sulfamate, the current density during plating, and the temperature of the plating bath in appropriate ranges, and adding an organic additive such as o-benzenesulfonimide or p-toluenesulfonamide, or an element such as Zn, S or Mn. Besides, in alloy plating such as Ni—Fe alloy, Ni—Mn alloy, Ni—P alloy, Ni—Co alloy or Ni—Sn alloy, the stress may be controlled by selecting the content of Fe, Mn, P, Co or Sn in the alloy, the temperature of the plating bath, and other parameters in appropriate ranges. In the case of alloy plating, addition of organic additives may, of course, be effective for stress control.

Plating may be carried out in a standard way by selecting any one of well-known plating baths for deposition of a single metal or alloy and using plating conditions common to that bath.

Examples of the preferred electroplating bath include a sulfamate Watts nickel electroplating bath containing 250 to 600 g/L of nickel sulfamate, 50 to 200 g/L of nickel sulfate, 5 to 70 g/L of nickel chloride, 20 to 40 g/L of boric acid, and an amount of o-benzenesulfonimide; and a pyrophosphoric acid copper electroplating bath containing 30 to 150 g/L of copper pyrophosphate, 100 to 450 g/L of potassium pyrophosphate, 1 to 20 mL/L of 25% ammonia water, and 5 to 20 g/L of potassium nitrate. A typical electroless plating bath is a nickel-phosphorus alloy electroless plating bath containing 10 to 50 g/L of nickel sulfate, 10 to 50 g/L of sodium hypophosphite, 10 to 30 g/L of sodium acetate, 5 to 30 g/L of sodium citrate, and an amount of thiourea.

By the plating method, abrasive grains which may be diamond abrasive grains, CBN abrasive grains or a mixture of diamond and CBN abrasive grains are bonded together and to the outer periphery of the base to form at a high accuracy a blade section having dimensions approximate to the final shape.

The blade section thus formed contains voids between abrasive grains and between abrasive grains and the base. According to the invention, a metal and/or alloy binder having a melting point of up to 350° C. is infiltrated into the voids. Therefore, the blade section of the outer blade cutting wheel is characterized in that a metal and/or alloy having a melting point of up to 350° C. is present between abrasive grains and between abrasive grains and the base throughout the blade section from the surface to the interior.

Suitable binders or infiltrants include metals such as Sn and Pb, and alloys such as Sn—Ag—Cu alloy, Sn—Ag alloy, Sn—Cu alloy, Sn—Zn alloy and Sn—Pb alloy, which may be used alone or as a mixture containing at least two of the foregoing.

The metal or alloy may be infiltrated into the blade section, for example, by working the metal or alloy into a wire with a diameter of 0.1 to 2.0 mm, preferably 0.8 to 1.5 mm, particles, or a thin-film ring of the same shape and size as the blade section having a thickness of 0.05 to 1.5 mm, resting the wire, particles or ring on the blade section, heating the blade section on a heater such as a hot plate or in an oven to a temperature above the melting point, holding the temperature for letting the melted metal or alloy infiltrate into the blade section, and thereafter slowly cooling to room temperature. Alternatively, infiltration is carried out by placing the outer blade cutting wheel in a lower mold half with a clearance near the blade section, charging the mold half with a weighed amount of metal or alloy, mating an upper mold half with the lower mold half, heating the mated mold while applying a certain pressure across the mold, for letting the melted metal or alloy infiltrate into the blade section. Thereafter the mold is cooled, the pressure is then released, and the wheel is taken out of the mold. The cooling step following heating should be slow so as to avoid any residual strains.

Before the metal or alloy is rested on the blade section, an agent for retaining the metal or alloy to the blade section or improving the wettability of the blade section, for example, a commercially available solder flux containing chlorine or fluorine may be applied to the blade section.

When a low-melting-point metal or alloy having relatively good wettability is used, infiltration may be carried out by sandwiching the base between metal members of stainless steel, iron or copper, conducting electricity to the metal members, causing the metal members to generate heat, thereby heating the base and the blade section, and bringing the heated blade section in contact with a molten low-melting-point metal.

In the resulting blade section, the abrasive grains, the magnetic material covering abrasive grains, the metal bond, and the metal or alloy binder infiltrated into voids are properly dispersed.

The metal or alloy to be infiltrated into the blade section should preferably have the following physical properties. The melting point is not higher than 350° C., preferably not higher than 300° C., for the purpose of preventing the cemented carbide base from being distorted to aggravate dimensional accuracy or change mechanical strength, and preventing the blade section from deformation or strain generation due to an outstanding difference in thermal expansion between the cemented carbide base and the blade section.

The metal or alloy preferably has an elasticity as demonstrated by a Poisson's ratio between 0.3 and 0.48, more preferably between 0.33 and 0.44. A metal with a Poisson's ratio of less than 0.3 lacks flexibility and is difficult to smoothly merge the cut surfaces. A metal with a Poisson's ratio of more than 0.48 is short of other physical properties such as hardness, with a risk of the blade edge experiencing noticeable deformation. The Poisson's ratio may be measured by the pulse ultrasonic method using an infiltrating metal or alloy sample of 15×15×15 mm.

The metal or alloy may have a hardness which is not so high as to prevent self-sharpening of abrasive grains (a phenomenon that new abrasive grains emerge, contributing to the cutting operation) when abrasive grains are worn, broken or shed during the cutting operation, and which is lower than that of the metal bond for bonding the abrasive grains and the magnetic material coating thereon. Also preferably, the infiltrating metal or alloy should not undergo strength changes or corrosion even when exposed to the machining fluid or coolant used during the machining process.

If necessary, the blade section having the metal or alloy infiltrated therein is tailored to the desired size by grinding with a grinding wheel of aluminum oxide, silicon carbide or diamond or electro-discharge machining. At this point, the blade section at the edge may be chamfered (beveled or rounded) to a degree of at least C0.1 or R0.1, though depending on the thickness of the blade section, because such chamfering is effective for reducing cut marks on the cut surface or mitigating chipping of a magnet piece at the end.

On use of the outer blade cutting wheel of the invention, various workpieces may be cut thereby. Typical workpieces include R—Co rare earth sintered magnets and R—Fe—B rare earth sintered magnets wherein R is at least one of rare earth elements inclusive of Y. These magnets are prepared as follows.

R—Co rare earth sintered magnets include RCo, and $R_2Co_{17}$ systems. Of these, the $R_2Co_{17}$ magnets have a composition (in % by weight) comprising 20-28% R, 5-30% Fe, 3-10% Cu, 1-5% Zr, and the balance of Co. They are prepared by weighing source materials in such a formulation, melting them, casting the melt, and finely pulverizing the alloy to an average particle size of 1-20 μm, yielding a $R_2Co_{17}$ magnet powder. The powder is then compacted in a magnetic field and sintered at 1,100-1,250° C. for 0.5-5 hours. The sintered body is subjected to solution treatment at a temperature lower than the sintering temperature by 0-50° C. for 0.5-5 hours, and aging treatment of holding at 700-950° C. for a certain time and subsequent cooling.

R—Fe—B rare earth sintered magnets have a composition (in % by weight) comprising 5-40% R, 50-90% Fe, and 0.2-8% B. An additive element or elements may be added thereto for improving magnetic properties and corrosion resistance, the additive elements being selected from C, Al, Si, Ti, V, Cr, Mn, Co, Ni, Cu, Zn, Ga, Zr, Nb, Mo, Ag, Sn, Hf, Ta, W, etc. The amount of additive element is up to 30% by weight for Co, and up to 8% by weight for the other elements. The magnets are prepared by weighing source materials in such a formulation, melting them, casting the melt, and finely pulverizing the alloy to an average particle size of 1-20 μm, yielding a R—Fe—B magnet powder. The powder is then compacted in a magnetic field and sintered at 1,000-1,200° C. for 0.5-5 hours, followed by aging treatment of holding at 400-1,000° C. for a certain time and subsequent cooling.

The outer blade cutting wheel of the invention is used to cut a rare earth magnet block into magnet pieces at a high dimensional accuracy without leaving cut marks on the cut surface. This is true particularly when the blade section at the edge has a compressive shearing stress in a specific range. For example, the outer blade cutting wheel includes a blade section which has a thickness of 0.1 to 1.0 mm and an outer diameter of 80 to 200 mm, and is chamfered (rounded or beveled) at the edge to a degree of at least R0.1 or C0.1. The cutting wheel is horizontally mounted on a jig by sandwiching the cutting wheel between circular iron plates of 5 mm thick such that only the blade section is exposed. The wheel is thus held so that the base may not be warped upon compression. At a position spaced 0.3 mm outward from the outer periphery of the base, the blade section is compressed by a probe in an axial direction of the rotating shaft of the cutting wheel (or thickness direction of the blade section) at a linear speed of 1 mm/min, the probe having a contact area with a length equal to a radial protrusion (mm) of the blade section minus 0.3 mm and a width of 10 mm. The stress reacting to the travel distance of the probe is measured. Compression is continued until the blade section is ruptured. As the travel distance of the probe increases, a region where the graph exhibits linearity, that is, a region where the stress is in proportion to the travel distance of the probe is acknowledged. A gradient of the graph in the region of stress proportional to deformation amount is computed. As long as the gradient is in a range of 100 to 10,000 N/mm, the cutting wheel is effective in cutting a magnet block into magnet pieces at a high dimensional accuracy without cut marks on the cut surface.

EXAMPLES

Examples and Comparative Example are given below by way of illustration and not by way of limitation.

Example 1

A cemented carbide consisting of 90 wt % WC and 10 wt % Co was machined into an annular thin disc having an outer diameter of 125 mm, an inner diameter of 40 mm, and a thickness of 0.3 mm, which served as a base. The base had a Young's modulus of 600 GPa and a saturation magnetization of 127 kA/m (0.16 T).

The cemented carbide base was masked with adhesive tape so that only a circumferential region of either surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 A/dm$^2$. The base was ultrasonic washed in deionized water and immersed in a sulfamate Watts nickel plating bath at 50° C. where an undercoat was plated at a current density of 5-20 A/dm$^2$. Once the masking tape was peeled off, the base was washed with water.

A polyphenylene sulfide (PPS) resin disc having an outer diameter of 130 mm and a thickness of 10 mm was machined on one side surface to form a groove having an outer diameter of 123 mm, an inner diameter of 119 mm, and a depth of 1.5 mm. In the groove of the disc, 75 permanent magnet segments of 2.5 mm long by 2 mm wide by 1.5 mm thick (N39UH by Shin-Etsu Rare Earth Magnets Co., Ltd., Br=1.25 T) were arranged at an equal spacing, with the thickness direction of the segment aligned with the depth direction of the groove. The groove was filled with an epoxy resin to fixedly secure the magnet segments in the groove, completing a magnet-built-in holder. The base was sandwiched between a pair of such holders to construct a jig, with the magnet sides of the holders faced inside. In the sandwiched state, the magnet was spaced inward a distance of 1 mm from the base outer periphery along the base surface. The magnet produced a magnetic field near the base outer periphery, which was analyzed to have a strength of at least 8 kA/m (0.01 T) within a space extending a distance of 10 mm from the base outer periphery.

Diamond abrasive grains were previously NiP-plated to form coated diamond abrasive grains having a mass magnetic susceptibility $\chi g$ of 0.588 and an average grain size of 135 μm. In a recess defined by the holders and the base, 0.4 g of the coated diamond abrasive grains were fed whereby the abrasive grains were magnetically attracted to and uniformly distributed over the entire base outer periphery. The jig with the abrasive grains attracted thereto was immersed in a sulfamate Watts nickel plating bath at 50° C. where electroplating was effected at a current density of 5-20 A/dm$^2$. The jig was taken out and washed with water. The procedure of magnetically attracting 0.4 g of coated diamond abrasive grains, electroplating, and water washing was repeated.

The holders of the jig were replaced by PPS resin disc holders having an outer diameter of 123 mm and a thickness of 10 mm. The base was sandwiched between the holders so that the side surfaces of the abrasive grain layer were exposed. The jig was immersed in a sulfamate Watts nickel plating bath at 50° C. where electricity was conducted at a current density of 5-20 A/dm$^2$ to deposit a plating over the entire blade section. The jig was taken out and washed with water, after which the base was dismounted and dried, obtaining an outer blade cutting wheel.

A wire of 1.0 mm diameter was made of Sn-3Ag-0.5Cu alloy. It is noted that the alloy had a melting point of 220° C. and a Poisson's ratio of 0.35. A ring of the wire was rested on the side surface of the blade section of the outer blade cutting wheel, which was placed in an oven. The oven was heated up to 200° C., and after confirming an internal temperature reaching 200° C., further heated up to 250° C., held at 250° C. for about 5 minutes, and then turned off. The wheel was allowed to cool down in the oven.

Figure 5:
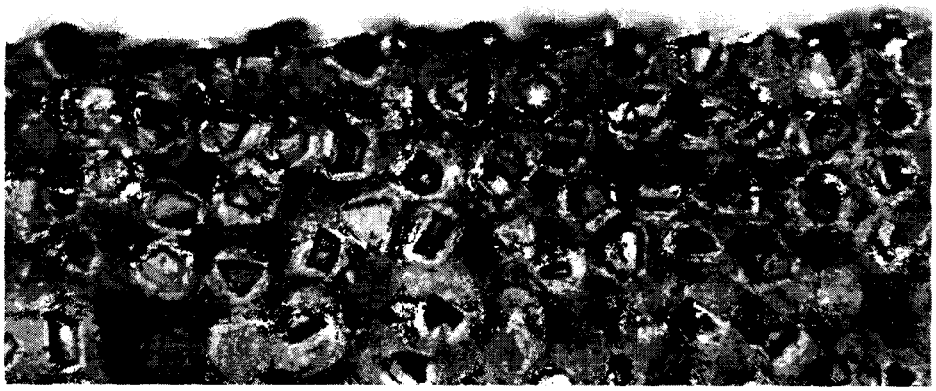
FIG. 5 is a photomicrograph of a blade section of an outer blade cutting wheel in Example 1 on its side surface.

Using a surface grinding machine, the wheel was ground to tailor the axial protrusion or thickness of the abrasive grain layer such that the abrasive layer protruded a distance (T3) of 50 μm beyond the cemented carbide base on each surface. The outer diameter was tailored by wire electrodischarge grinding (WEDG). The wheel was dressed, yielding a cemented carbide base outer blade cutting wheel having an abrasive grain layer or blade section with a thickness (T2) of 0.4 mm and an outer diameter of 127 mm. FIG. 5 is a photomicrograph of the side surface of the blade section.

Example 2

A cemented carbide consisting of 90 wt % WC and 10 wt % Co was machined into an annular thin disc having an outer diameter of 125 mm, an inner diameter of 40 mm, and a thickness of 0.3 mm, which served as a base.

The cemented carbide base was masked with adhesive tape so that only a circumferential region of either surface extending 1.5 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 A/dm$^2$. The base was ultrasonic washed in deionized water and immersed in a sulfamate Watts nickel plating bath at 50° C. where an undercoat was plated at a current density of 5-20 A/dm$^2$. Once the masking tape was peeled off, the base was washed with water.

A PPS resin disc having an outer diameter of 130 mm and a thickness of 10 mm was machined on one side surface to form a groove having an outer diameter of 123 mm, an inner diameter of 119 mm, and a depth of 1.5 mm. In the groove of the disc, 105 permanent magnet segments of 1.8 mm long by 2 mm wide by 1.5 mm thick (N32Z by Shin-Etsu Rare Earth Magnets Co., Ltd., Br=1.14 T) were arranged at an equal spacing, with the thickness direction of the segment aligned with the depth direction of the groove. The groove was filled with an epoxy resin to fixedly secure the magnet segments in the groove, completing a magnet-built-in holder. The base was sandwiched between a pair of such holders to construct a jig, with the magnet sides of the holders faced inside. In the sandwiched state, the magnet was spaced inward a distance of 1.5 mm from the base outer periphery along the base surface. The magnet produced a magnetic field near the base outer periphery, which was analyzed to have a strength of at least 16 kA/m (0.02 T) within a space extending a distance of 10 mm from the base outer periphery.

Diamond abrasive grains were previously NiP-plated to form coated diamond abrasive grains having a mass magnetic susceptibility $\chi g$ of 0.588 and an average grain size of 135 μm. In a recess defined by the holders and the base, 0.4 g of the coated diamond abrasive grains were fed whereby the abrasive grains were magnetically attracted to and uniformly distributed over the entire base outer periphery. The jig with the abrasive grains attracted thereto was immersed in a sulfamate Watts nickel plating bath at 50° C. where electroplating was effected at a current density of 5-20 A/dm$^2$. The jig was taken out and washed with water. The procedure of magnetically attracting 0.4 g of coated diamond abrasive grains, electroplating, and water washing was repeated three times.

The holders of the jig were replaced by PPS resin disc holders having an outer diameter of 123 mm and a thickness of 10 mm. The base was sandwiched between the holders so that the side surfaces of the abrasive grain layer were exposed. The jig was immersed in a sulfamate Watts nickel plating bath at 50° C. where electricity was conducted at a current density of 5-20 A/dm$^2$ to deposit a plating over the entire blade section. The jig was taken out and washed with water, after which the base was dismounted and dried, obtaining an outer blade cutting wheel.

Beads of 0.3 mm diameter were made of Sn-3Ag alloy. It is noted that the alloy had a melting point of 222° C. and a Poisson's ratio of 0.3. The beads were circumferentially rested on the side surface of the blade section of the outer blade cutting wheel, which was placed in an oven. The oven was heated up to 200° C., and after confirming an internal temperature reaching 200° C., further heated up to 250° C., held at 250° C. for about 5 minutes, and then turned off. The wheel was allowed to cool down in the oven.

Using a surface grinding machine, the wheel was ground to tailor the axial protrusion or thickness of the abrasive grain layer such that the abrasive layer protruded a distance of 50 μm beyond the cemented carbide base on each surface. The outer diameter was tailored by WEDG. The wheel was dressed, yielding a cemented carbide base outer blade cutting wheel having an abrasive grain layer or blade section with a thickness of 0.4 mm and an outer diameter of 129 mm.

Example 3

A cemented carbide consisting of 90 wt % WC and 10 wt % Co was machined into an annular thin disc having an outer diameter of 125 mm, an inner diameter of 40 mm, and a thickness of 0.3 mm, which served as a base.

The cemented carbide base was masked with adhesive tape so that only a circumferential region of either surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 A/dm$^2$. The base was ultrasonic washed in deionized water and immersed in a sulfamate Watts nickel plating bath at 50° C. where an undercoat was plated at a current density of 5-20 A/dm$^2$. Once the masking tape was peeled off, the base was washed with water.

The base was sandwiched between the holders of the jig as in Example 1. Diamond abrasive grains were previously NiP-plated to form coated diamond abrasive grains having a mass magnetic susceptibility $\chi g$ of 0.392 and an average grain size of 130 μm. In a recess defined by the holders and the base, 0.4 g of the coated diamond abrasive grains were fed whereby the abrasive grains were magnetically attracted to and uniformly distributed over the entire base outer periphery. The jig with the abrasive grains attracted thereto was immersed in a copper pyrophosphate plating bath at 40° C. where electroplating was effected at a current density of 1-20 A/dm$^2$. The jig was taken out and washed with water. The wheel was dismounted from the jig and dried.

A wire of 1.0 mm diameter was made of Sn—Pb alloy. It is noted that the alloy had a melting point of 185° C. and a Poisson's ratio of 0.38. A ring of the wire was rested on the side surface of the blade section of the outer blade cutting wheel, which was placed in an oven. The oven was heated up to 200° C., and after confirming an internal temperature reaching 200° C., further heated up to 250° C., held at 250° C. for about 5 minutes, and then turned off. The wheel was allowed to cool down in the oven.

Using a surface grinding machine, the wheel was ground to tailor the axial protrusion or thickness of the abrasive grain layer such that the abrasive layer protruded a distance of 50 μm beyond the cemented carbide base on each surface. The outer diameter was tailored by WEDG. The wheel was dressed, yielding a cemented carbide base outer blade cutting wheel having an abrasive grain layer or blade section with a thickness of 0.4 mm and an outer diameter of 126 mm.

Example 4

A cemented carbide consisting of 95 wt % WC and 5 wt % Co was machined into an annular thin disc having an outer diameter of 125 mm, an inner diameter of 40 mm, and a thickness of 0.3 mm, which served as a base. The base had a Young's modulus of 580 GPa and a saturation magnetization of 40 kA/m (0.05 T).

The cemented carbide base was masked with adhesive tape so that only a circumferential region of either surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 A/dm$^2$. The base was ultrasonic washed in deionized water and immersed in a sulfamate Watts nickel plating bath at 50° C. where an undercoat was plated at a current density of 5-20 A/dm$^2$. Once the masking tape was peeled off, the base was washed with water.

The base was sandwiched between the holders of the jig as in Example 1. Diamond abrasive grains were previously NiP-plated to form coated diamond abrasive grains having a mass magnetic susceptibility $\chi g$ of 0.392 and an average grain size of 130 μm. In a recess defined by the holders and the base, 0.3 g of the coated diamond abrasive grains were fed whereby the abrasive grains were magnetically attracted to and uniformly distributed over the entire base outer periphery. The jig with the abrasive grains attracted thereto was immersed in an electroless nickel-phosphorus alloy plating bath at 80° C. where electroless plating was effected. The jig was taken out and washed with water. The procedure of magnetically attracting 0.3 g of coated diamond abrasive grains, electroless plating, and water washing was repeated twice. The wheel was dismounted from the jig and dried.

A wire of 1.0 mm diameter was made of Sn-3Ag-0.5Cu alloy. A ring of the wire was rested on the side surface of the blade section of the outer blade cutting wheel, which was placed in an oven. The oven was heated up to 200° C., and after confirming an internal temperature reaching 200° C., further heated up to 250° C., held at 250° C. for about 5 minutes, and then turned off. The wheel was allowed to cool down in the oven.

Using a surface grinding machine, the wheel was ground to tailor the axial protrusion or thickness of the abrasive grain layer such that the abrasive layer protruded a distance of 50 μm beyond the cemented carbide base on each surface. The outer diameter was tailored by WEDG. The wheel was dressed, yielding a cemented carbide base outer blade cutting wheel having an abrasive grain layer or blade section with a thickness of 0.4 mm and an outer diameter of 127 mm.

Comparative Example 1

A cemented carbide consisting of 90 wt % WC and 10 wt % Co was machined into an annular thin disc having an outer diameter of 125 mm, an inner diameter of 40 mm, and a thickness of 0.3 mm, which served as a base.

The cemented carbide base was masked with adhesive tape so that only a circumferential region of either surface extending 1.0 mm inward from the outer periphery was exposed. The base was immersed in a commercially available aqueous alkaline solution at 40° C. for 10 minutes for degreasing, washed with water, and immersed in an aqueous solution of 30-80 g/L of sodium pyrophosphate at 50° C. where electrolysis was effected at a current density of 2-8 A/dm$^2$. The base was ultrasonic washed in deionized water and immersed in a sulfamate Watts nickel plating bath at 50° C. where an undercoat was plated at a current density of 5-20 A/dm$^2$. Once the masking tape was peeled off, the base was washed with water.

The base was sandwiched between the holders of the jig as in Example 1. Diamond abrasive grains were previously NiP-plated to form coated diamond abrasive grains having a mass magnetic susceptibility $\chi g$ of 0.392 and an average grain size of 130 μm. In a recess defined by the holders and the base, 0.4 g of the coated diamond abrasive grains were fed whereby the abrasive grains were magnetically attracted to and uniformly distributed over the entire base outer periphery. The jig with the abrasive grains attracted thereto was immersed in a sulfamate Watts nickel plating bath at 50° C. where electroplating was effected at a current density of 5-20 A/dm$^2$. The jig was taken out and washed with water. The procedure of magnetically attracting 0.4 g of coated diamond abrasive grains, electroplating, and water washing was repeated.

The holders of the jig were replaced by PPS resin disc holders having an outer diameter of 123 mm and a thickness of 10 mm. The base was sandwiched between the holders so that the side surfaces of the abrasive grain layer were exposed. The jig was immersed in a sulfamate Watts nickel plating bath at 50° C. where electricity was conducted at a current density of 5-20 A/dm$^2$ to deposit a plating over the entire blade section. The jig was taken out and washed with water. The base was dismounted and dried, obtaining an outer blade cutting wheel.

Using a surface grinding machine, the wheel was ground to tailor the axial protrusion or thickness of the abrasive grain layer such that the abrasive layer protruded a distance of 50 μm beyond the cemented carbide base on each surface. The outer diameter was tailored by WEDG. The wheel was dressed, yielding a cemented carbide base outer blade cutting wheel having an abrasive grain layer or blade section with a thickness of 0.4 mm and an outer diameter of 127 mm.

Table 1 reports the percent yields of manufacture of the cemented carbide base outer blade cutting wheels of Examples 1 to 4 and Comparative Example 1. A percent plating yield is calculated by preparing 15 samples in each Example until the step of bonding abrasive grains by plating, judging samples as good when no abrasive grains shed or the abrasive grain layer was not defective, and dividing the number of good samples by the number of plated samples. A percent working yield is calculated by performing the steps following the bond metal plating step until the dressing step on good samples, judging samples as good when the abrasive grain layer was not defective, and dividing the number of good samples by the number of starting good plated samples. An overall percent yield is the percent plating yield multiplied by the percent working yield, indicating a percent yield of good samples as the completed outer blade cutting wheel relative to the number of starting bases used in the manufacture of cutting wheels.

TABLE 1

| | Example 1 | Example 2 | Example 3 | Example 4 | Comparative Example 1 |
|---|---|---|---|---|---|
| Plating yield (%) | 100 | 100 | 100 | 93 | 100 |
| Working yield (%) | 100 | 100 | 100 | 100 | 87 |
| Overall yield (%) | 100 | 100 | 100 | 93 | 87 |

It is seen from Table 1 that the yields of Examples are better than Comparative Example 1. In particular, the working yield following plating is satisfactory. It is demonstrated that the manufacture method of the invention is improved in productivity as well.

Figure 6:
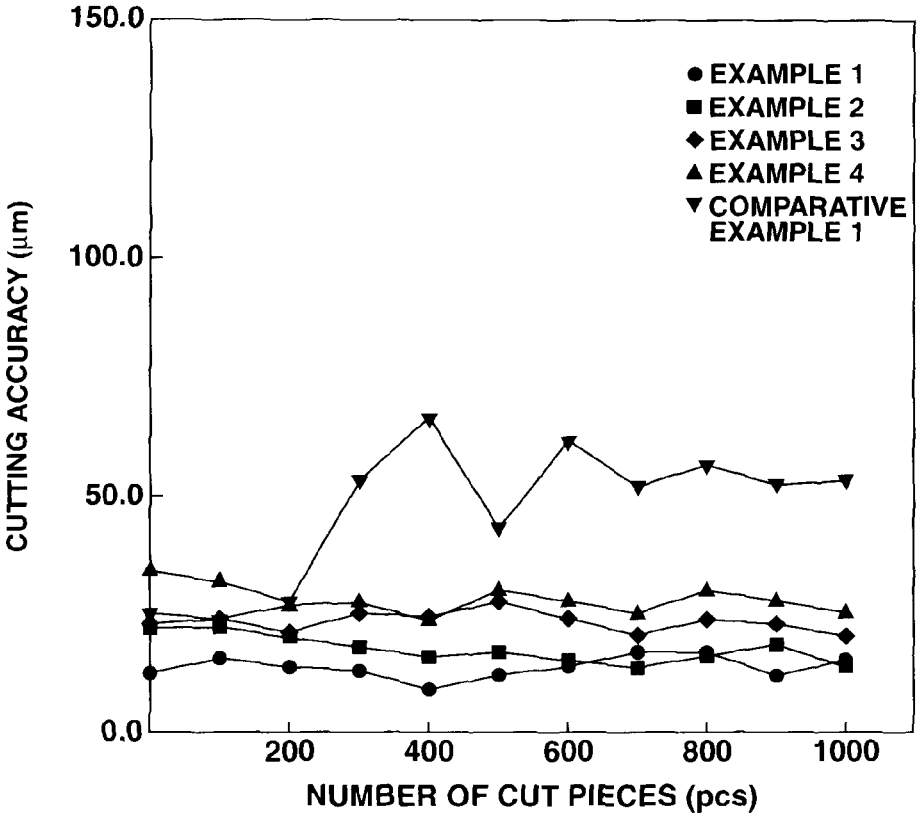
FIG. 6 is a diagram showing cutting accuracy versus the number of magnet pieces cut using the outer blade cutting wheels of Examples 1 to 4 and Comparative Example 1.

Using the cemented carbide base outer blade cutting wheel, a rare earth sintered magnet block was cutoff machined into magnet pieces. The cutting accuracy of magnet pieces is plotted in the diagram of FIG. 6.

The cutting accuracy was evaluated by providing ten outer blade cutting wheels of Examples 1 to 4 and Comparative Example 1, two wheels for each Example. A multiple wheel assembly was constructed by arranging ten cutting wheels at a spacing of 1.5 mm, inserting a rotating shaft into the bores in the bases, and fastening them together. By operating the multiple wheel assembly at 4,500 rpm and a feed speed of 30 mm/min, a Nd—Fe—B rare earth sintered magnet block of 40 mm wide by 130 mm long by 20 mm high was cutoff machined into magnet pieces of 40 mm wide by 1.5 mm long (=thickness (t)) by 20 mm high. The cutting operation was repeated until the number of cut magnet pieces totaled to 1,010. Of these, the magnet pieces cut between a pair of cutting wheels of the same Example were selected for examination. Every size measuring cycle included from #1 to #100 pieces, indicating total ten cycles. Early ten pieces in each cycle are sampled out (i.e., #1 to #10 from the first cycle, #101 to #110 from the second cycle, and so forth, and #1,001 to #1,010 from the last cycle). For ten pieces in each cycle, the thickness (t) of each piece was measured at the center and four corners (five points in total) by a micrometer. A difference between maximum and minimum among five measurements is the cutting accuracy (μm). An average value of the cutting accuracies of ten pieces was computed. This average value of every size measuring cycle is plotted in the diagram of FIG. 6.

In Comparative Example 1, the cutting accuracy worsened after three size measuring cycles (from #301 cut magnet piece et seq.). In Examples 1 to 4, the cutting accuracy did not worsen until the tenth cycle (until #1,010 cut magnet piece). It is demonstrated that the outer blade cutting wheels of the invention are fully durable in service.

Figure 7:
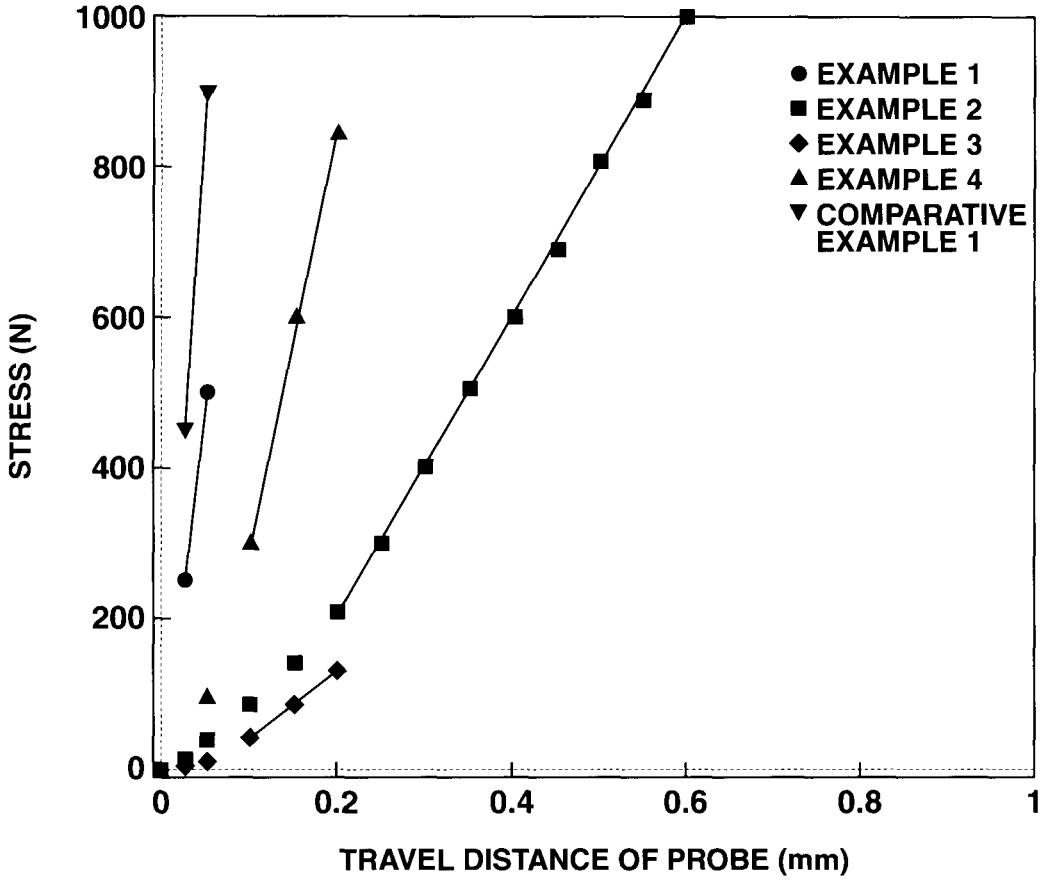
FIG. 7 is a diagram showing stress versus deformation of the blade sections of the outer blade cutting wheels of Examples 1 to 4 and Comparative Example 1.

The elasticity or flexibility of the outer blade cutting wheel was evaluated, with the results plotted in the diagram of FIG. 7. The compressive shearing stress of the outer blade cutting wheel at the edge was evaluated. Specifically, the outer blade cutting wheel was chamfered (rounded or beveled) at the edge to a degree of at least R0.1 or C0.1. The cutting wheel was horizontally mounted on a jig by sandwiching the cutting wheel between circular iron plates of 5 mm thick such that only the blade section was exposed. The wheel was thus held so that the base might not be warped upon compression. At a position spaced 0.3 mm outward from the outer periphery of the base, the blade section was compressed by a probe in an axial direction of the rotating shaft of the cutting wheel (or thickness direction of the blade section) at a linear speed of 1 mm/min, the probe having a contact area with a length equal to {a protrusion (mm) of the blade section minus 0.3 mm} and a width of 10 mm. The stress reacting to the travel distance of the probe was measured by a strength tester AG-1 (Shimadzu Mfg. Co., Ltd.). Compression was continued until the blade section was ruptured.

As seen from FIG. 7, in all examples, as the travel distance of the probe increased, a region where the graph exhibited linearity, that is, a region where the stress was in proportion to the travel distance of the probe was observed. A gradient of the graph in the linear region (i.e., stress/travel distance of probe) was computed, with the results shown in Table 2.

TABLE 2

| | Example 1 | Example 2 | Example 3 | Example 4 | Comparative Example 1 |
|---|---|---|---|---|---|
| Gradient (N/mm) | 10,000 | 2,000 | 900 | 5,000 | 18,000 |

In the above cutting test, all magnet pieces cut using the outer blade cutting wheels of Examples had good-looking cut surfaces. In the case of magnet pieces cut using the outer blade cutting wheels of Comparative Example 1, some samples had cut marks or steps on the cut surface after three size measuring cycles (from #301 cut magnet piece et seq.). It is demonstrated that as long as the gradient given as stress relative to travel distance of probe and indicative of the elasticity or flexibility of the cutting wheel is not so high, that is, the blade section has a certain degree of flexibility, the outer blade cutting wheel is effective for cutoff machining a magnet block into magnet pieces at a high dimensional accuracy without cut marks on the cut surface.

It is demonstrated that when a workpiece, typically a rare earth sintered magnet block is cutoff machined into pieces using the outer blade cutting wheels of the invention, the pieces as cut have a high accuracy without a need for finishing after cutting. Pieces having a high dimensional accuracy are available.

The invention claimed is:

1. An outer blade cutting wheel comprising a base in the form of an annular thin disc of cemented carbide having a Young's modulus of 450 to 700 GPa, having an outer diameter of 80 to 200 mm defining an outer periphery, an inner diameter of 30 to 80 mm, and a thickness of 0.1 to 1.0 mm, and a blade section on the outer periphery of the base, said blade section comprising diamond and/or CBN abrasive grains pre-coated with a magnetic material, a first metal or alloy formed by electroplating or electroless plating, the first metal or alloy covering and bonding the pre-coated abrasive grains together and to the base, the pre-coated abrasive grains and the first metal or alloy constituting a porous bonded structure, and a second metal or alloy having a melting point of up to 350° C. infiltrated and filling pores of the porous bonded structure and between abrasive grains and the base.

2. The cutting wheel of claim wherein the second metal is Sn and/or Pb.

3. The cutting wheel of claim 1, wherein the second metal or alloy has a Poisson's ratio between 0.3 and 0.48.

4. The cutting wheel of claim 1, wherein said base has a saturation magnetization of at least 40 kA/m (0.05 T).

5. The cutting wheel of claim 1, wherein said abrasive grains have an average grain size of 10 to 300 μm.

6. The cutting wheel of claim 1, wherein said abrasive grains have a mass magnetic susceptibility $\chi g$ of at least 0.2.

7. The cutting wheel of claim 1, wherein the second alloy is at least one alloy selected from the group consisting of Sn—Ag—Cu, Sn—Ag, Sn—Cu, Sn—Zn, and Sn—Pb alloys.

8. A method for manufacturing an outer blade cutting wheel of claim 1, comprising the steps of:

providing a base in the form of an annular thin disc of cemented carbide having a Young's modulus of 450 to 700 GPa, having an outer diameter of 80 to 200 mm defining an outer periphery, an inner diameter of 30 to 80 mm, and a thickness of 0.1 to 1.0 mm, providing diamond and/or CBN abrasive grains pre-coated with a magnetic material, placing a permanent magnet near the outer periphery of the base so that the magnetic field produced by the permanent magnet may act to magnetically attract and hold the coated abrasive grains close to the outer periphery of the base, electroplating or electroless plating a first metal or alloy on the base outer periphery and the coated abrasive grains being magnetically attracted and held, for bonding the abrasive grains together and to the base to fixedly secure the abrasive grains to the base outer periphery to form a blade section with a porous structure constituted by the pre-coated abrasive grains and the first metal or alloy, and letting a second metal or alloy having a melting point of up to 350° C. infiltrate into pores of the porous structure.

9. The method of claim 8 wherein the second metal is Sn and/or Pb.

10. The method of claim 8 wherein the second metal or alloy has a Poisson's ratio between 0.3 and 0.48.

11. The method of claim 8, wherein said base has a saturation magnetization of at least 40 kA/m (0.05 T).

12. The method of claim 8, wherein said abrasive grains have an average grain size of 10 to 300 μm.

13. The method of claim 8, wherein said abrasive grains have a mass magnetic susceptibility $\chi g$ of at least 0.2.

14. The method of claim 8, wherein the permanent magnet produces a magnetic field of at least 8 kA/m within a space extending a distance of 10 mm or less from the base outer periphery.

15. The method of claim 8, wherein the second alloy is at least one alloy selected from the group consisting of Sn—Ag—Cu, Sn—Ag, Sn—Cu, Sn—Zn, and Sn—Pb alloys.

* * * * *